US007347744B2

(12) United States Patent
Tabata et al.

(10) Patent No.: US 7,347,744 B2
(45) Date of Patent: Mar. 25, 2008

(54) CONNECTOR AND A CONNECTOR ASSEMBLY METHOD

(75) Inventors: Masaaki Tabata, Yokkaichi (JP); Takeshi Tsuji, Yokkaichi (JP); Takehiro Nakata, Yokkaichi (JP); Tomohiko Kobayashi, Yokkaichi (JP); Satoshi Morikawa, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/472,570

(22) Filed: Jun. 20, 2006

(65) Prior Publication Data

US 2007/0004274 A1 Jan. 4, 2007

(30) Foreign Application Priority Data

Jun. 21, 2005 (JP) ..... 2005-180704

(51) Int. Cl.
*H01R 13/514* (2006.01)

(52) U.S. Cl. ..... 439/752; 439/289; 439/701

(58) Field of Classification Search ..... 439/701, 439/587, 752, 298
See application file for complete search history.

(56) References Cited

U.S. PATENT DOCUMENTS 5,725,397 A 3/1998 Fukamachi et al.
6,155,884 A 12/2000 Sugiyama
6,193,550 B1 2/2001 Yamashita et al.
6,332,813 B1 12/2001 Okabe et al.
6,488,546 B2 * 12/2002 Sakurai et al. ..... 439/701
6,514,098 B2 * 2/2003 Marpoe et al. ..... 439/352
6,619,996 B2 * 9/2003 Hara et al. ..... 439/701
6,638,108 B2 * 10/2003 Tachi ..... 439/595
6,984,149 B2 * 1/2006 Fukuda et al. ..... 439/587

FOREIGN PATENT DOCUMENTS

JP 2000-150058 5/2000

* cited by examiner

*Primary Examiner*—Truc Nguyen
(74) *Attorney, Agent, or Firm*—Gerald E. Hespos; Anthony J. Casella

(57) ABSTRACT

Each of a plurality of auxiliary connector (10) includes an auxiliary housing (11), a seal (40) attached to the rear of the auxiliary housing (11), and a rear holder (50) mounted on the rear of the seal (40) to retain the seal (40). Auxiliary connectors (10) that are adjacent in an arranging direction are united by the rear holders (50). The united auxiliary connectors (10) are inserted into a frame (60) in the arranging direction through an insertion opening (60A) of the frame (60), and are retained in the frame (60) by engaging a lock (50B) on the last auxiliary connector (10A) and an interlocking portion (61) of the frame (60). The frame (60) has no partition walls between the auxiliary connectors (10). Thus, the connector is narrowed by a total thickness of the partition walls.

12 Claims, 13 Drawing Sheets

CONNECTOR AND A CONNECTOR ASSEMBLY METHOD

BACKGROUND OF THE INVENTION

1. Field of the Invention

The invention relates to a connector and to a connector assembly method.

2. Description of the Related Art

Japanese Unexamined Patent Publication No. 2000-150058 discloses a connector with a plurality of auxiliary connectors. Each auxiliary connector has cavities for accommodating terminal fittings. The respective auxiliary connectors are accommodated individually in accommodating chambers of a frame of the connector. A seal is mounted on the rear surface of each auxiliary connector to provide sealing around wires connected with the terminal fittings and a rear holder is mounted on the rear surface of the seal to retain the seal.

The above-described divided connector is enlarged in an arranging or width direction of the auxiliary connectors. More particularly, the frame has partition walls for partitioning the accommodating chambers for the respective auxiliary connectors. The width of the frame is increased by a total thickness of the partition walls, and the connector is further enlarged. This may narrow the range of applications for the connector.

The invention was developed in view of the above problem and an object thereof is to miniaturize a connector.

SUMMARY OF THE INVENTION

The invention is a connector with a plurality of auxiliary connectors. At least one terminal fitting can be accommodated in each auxiliary connector. The connector further comprises a frame for receiving the respective auxiliary connectors en bloc. The auxiliary connectors are inserted into the frame in an arranging direction through an opening in one side surface of the frame. The auxiliary connectors and the frame comprise positioning means for determining the positions of the auxiliary connectors relative to the frame.

Partition walls are not needed between adjacent auxiliary connectors in the frame because the respective auxiliary connectors are inserted into the frame substantially in the arranging direction. Thus, the connector can be made smaller by as much as a total thickness of the partition walls. Further, the positioning means determines the relative positions of the auxiliary connectors in the frame. Hence, a positioning function that might otherwise be borne by the partitioning walls can be provided by the positioning means.

A partition wall of a mating auxiliary connector preferably can slide into a clearance between facing surfaces of two auxiliary connectors that are adjacent to each other in the arranging direction. Thus, forcible connection of the auxiliary connectors can be prevented. Accordingly, there is no need for a special forcible-connection preventing construction, and the connector can be made even smaller.

At least one seal preferably is arranged at a rear part of the each auxiliary connector to seal around wires connected with terminal fittings. Additionally, a wall of the mating auxiliary connector may be brought hermetically into close contact with a peripheral portion of the seal. Accordingly, the seal provides sealing between the seal and the mating auxiliary connectors and also seals between the seal and the wires connected with the terminal fittings. Thus, the auxiliary connector does not need a plurality of kinds of seals, and the number of parts can be reduced.

At least one rear holder preferably is assembled at a rear part of the respective auxiliary connectors for retaining the seal. The auxiliary connectors are united in the arranging direction by the rear holder and are accommodated into the frame in a united state to define the positioning means. Thus, assembling efficiency is improved and a sealing performance of the seal is ensured.

Plural rear holders preferably are provided in one-to-one correspondence with the respective auxiliary connectors and can be coupled to each other substantially in the arranging direction. Thus, an operation of inserting the terminal fittings can be performed for each auxiliary connector. As a result, erroneously inserted the terminal fittings are unlikely and the wires are easier to handle, thereby improving assembling efficiency.

Recess/projection engaging portions are provided on substantially facing surfaces of two rear holders adjacent to each other in the arranging direction. The recess/projection engaging portions preferably engage and permit an assembling operation of the two rear holders when the two rear holders are arranged in a correct combination, and preferably cannot engage and hinder the assembling operation of the two rear holders when the two rear holders are arranged in a wrong combination. Thus, the two rear holders cannot be coupled in a wrong combination.

The rear holder preferably has at least one protection wall for at least partly concealing an exposed end surface of the seal substantially facing the insertion opening at the auxiliary connector inserted last into the frame. Thus, external matter cannot interfere with or damage the seal At least one protection cap preferably is mounted detachably on the respective auxiliary connectors and surrounds the seal with a clearance. The protection cap preferably is mounted on the respective auxiliary connector before the auxiliary connectors are positioned by the positioning means. Thus, the seal is protected and maintains a specified sealing performance. The protection cap can be detached from the respective auxiliary connectors when the auxiliary connectors are positioned by the positioning means.

A retainer preferably is assembled into each auxiliary connector for retaining the properly inserted terminal fittings. The protection cap preferably has a retainer insertion opening for permitting insertion of the retainers into the respective auxiliary connectors. Thus, the retainers can be inserted with the protection cap mounted on the respective auxiliary connectors, and the protection of the seal can be assured doubly.

Each auxiliary connector preferably is formed with at least one guidable portion that can slide in contact with at least one guide of the frame when the auxiliary connector is mounted into the frame. The protection cap preferably has at least one mounting portion detachably engageable with the guidable portion before the auxiliary connectors are mounted into the frame. Thus, it is not necessary to provide the auxiliary connectors with a special construction for mounting the protection cap, and the constructions of the respective auxiliary connectors can be simplified.

The invention also is directed to a method for assembling a connector. The method includes providing a plurality of auxiliary connectors. The method then includes accommodating terminal fittings in the respective auxiliary connectors in a frame en bloc by inserting the respective auxiliary connectors into the frame substantially in an arranging direction through an opening formed in one side surface of the frame. The invention then includes positioning the auxiliary connectors relative to the frame by positioning means provided on the auxiliary connectors and/or the frame.

The connector assembly method may further comprise providing mating auxiliary connectors, and connecting at least two auxiliary connectors with the mating auxiliary connectors thereby slidably inserting a partition wall of mating auxiliary connectors into a clearance between facing surfaces of two auxiliary connectors adjacent to each other in the arranging direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector assembly according to the invention is described with reference to FIGS. 1 to 13. The assembly includes a divided watertight female connector that is connectable with a mating male connector. The female connector includes auxiliary connectors 10 that are accommodated in a frame 60. An end of the female connector that is to be connected with the male connector is referred to as the front in the following description.

Figure 12:
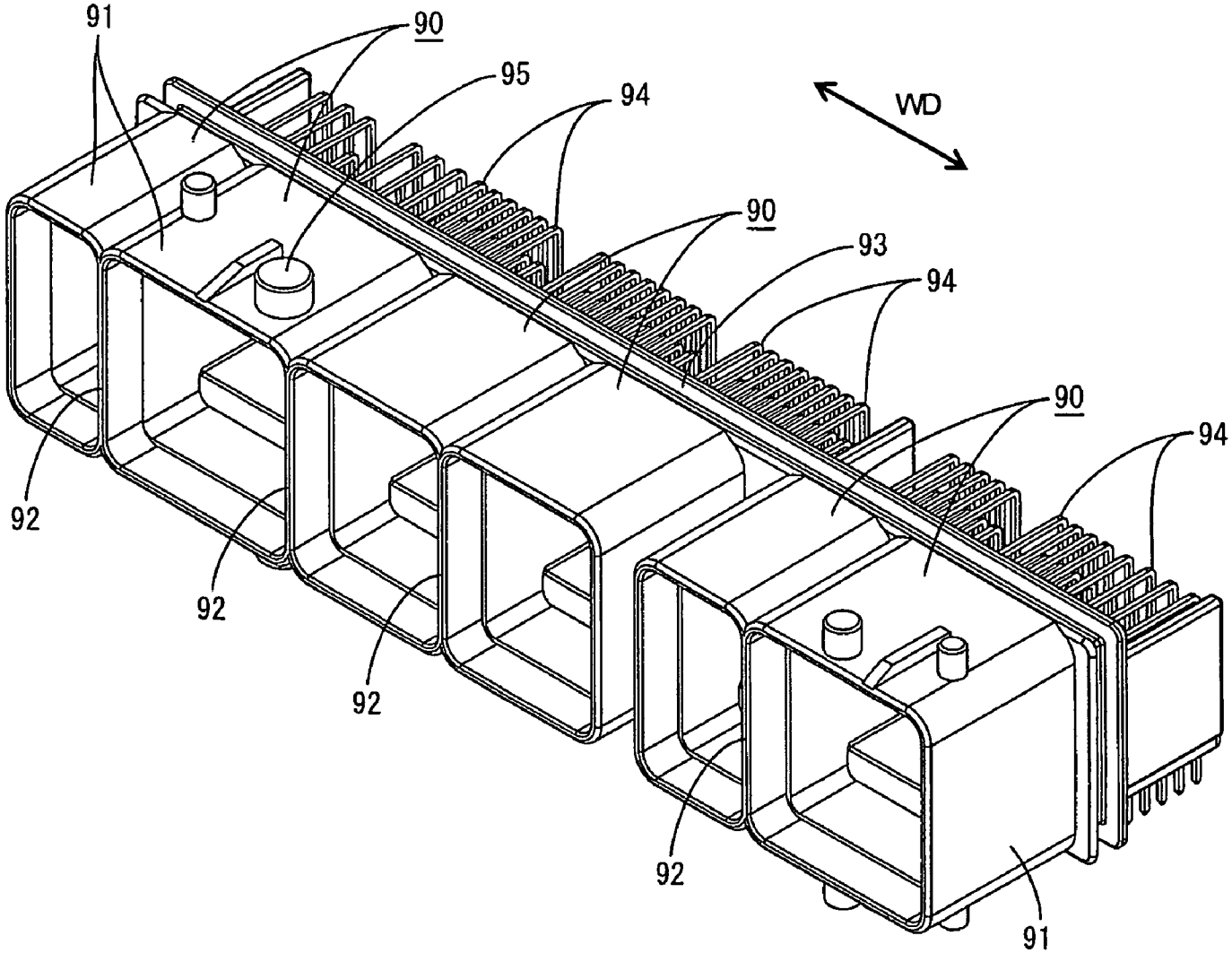
FIG. 12 is a perspective view of a mating connector.
Figure 13:
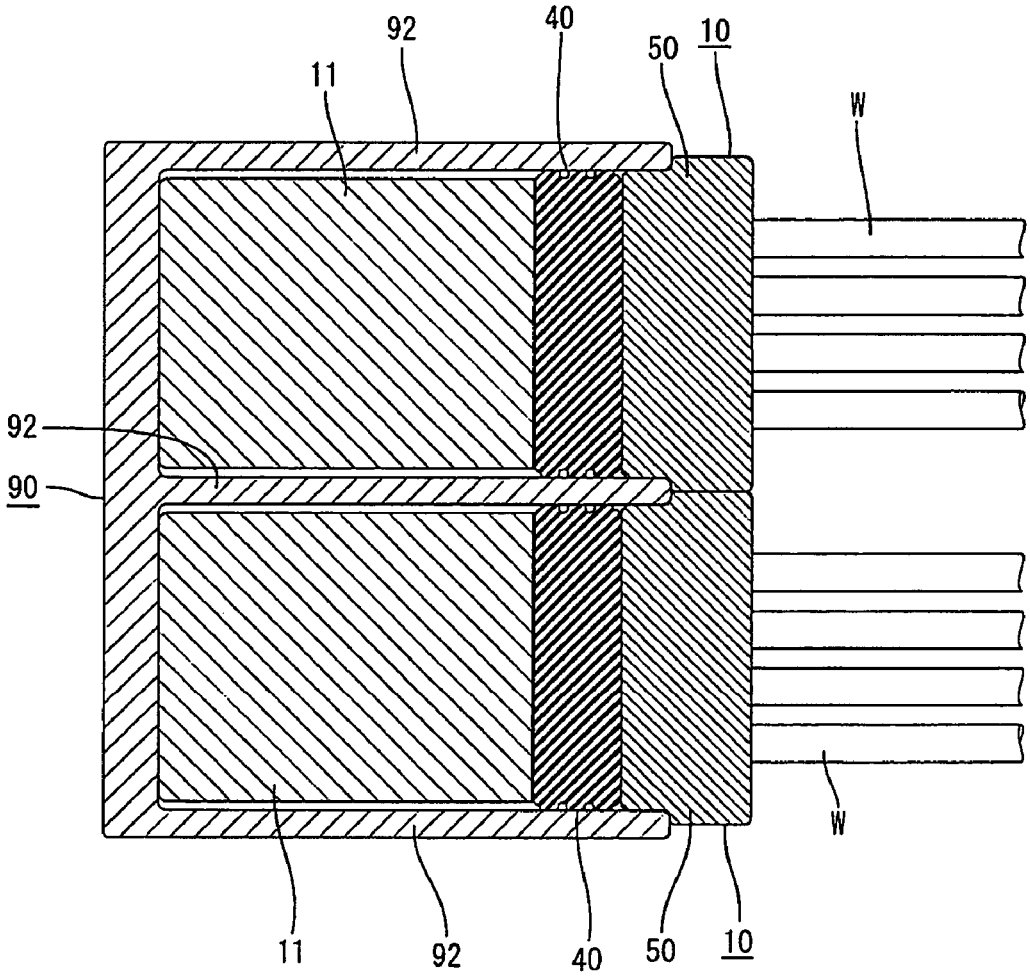
FIG. 13 is a schematic diagram of a connected state of the connectors.

As shown in FIGS. 12 and 13, the mating male connector is intended for mounting on a printed circuit board, and has a plurality of differently dimensioned male auxiliary connectors 90 arranged substantially side by side in a width direction WD. The auxiliary connectors 90 are coupled to each other by a coupling plate 93 arranged on the rear surfaces of the auxiliary connectors 90, as shown in FIG. 12. Each auxiliary connector 90 has a rectangular tubular receptacle 91 with an open front end. The receptacles 91 adjacent to each other in the width direction WD are partitioned by partition walls 92. Male terminal fittings 94 are mounted through the back walls of the receptacles 91 so that front portions of the male terminal fittings 94 project into the receptacles 91. Rear portions of the male terminal fittings 94 are exposed from the rear surface of the coupling plate 93 and are bent substantially at right angles at intermediate positions for connection with conductor paths of the circuit board (not shown). Cam pins 95 project from the upper surfaces of the receptacles 91 of some of the auxiliary connectors 90. The cam pins 95 are inserted into cam grooves 71 of a lever 70 mounted on the frame 60, and the connectors are connected with each other as the lever 70 is operated.

Figure 3:
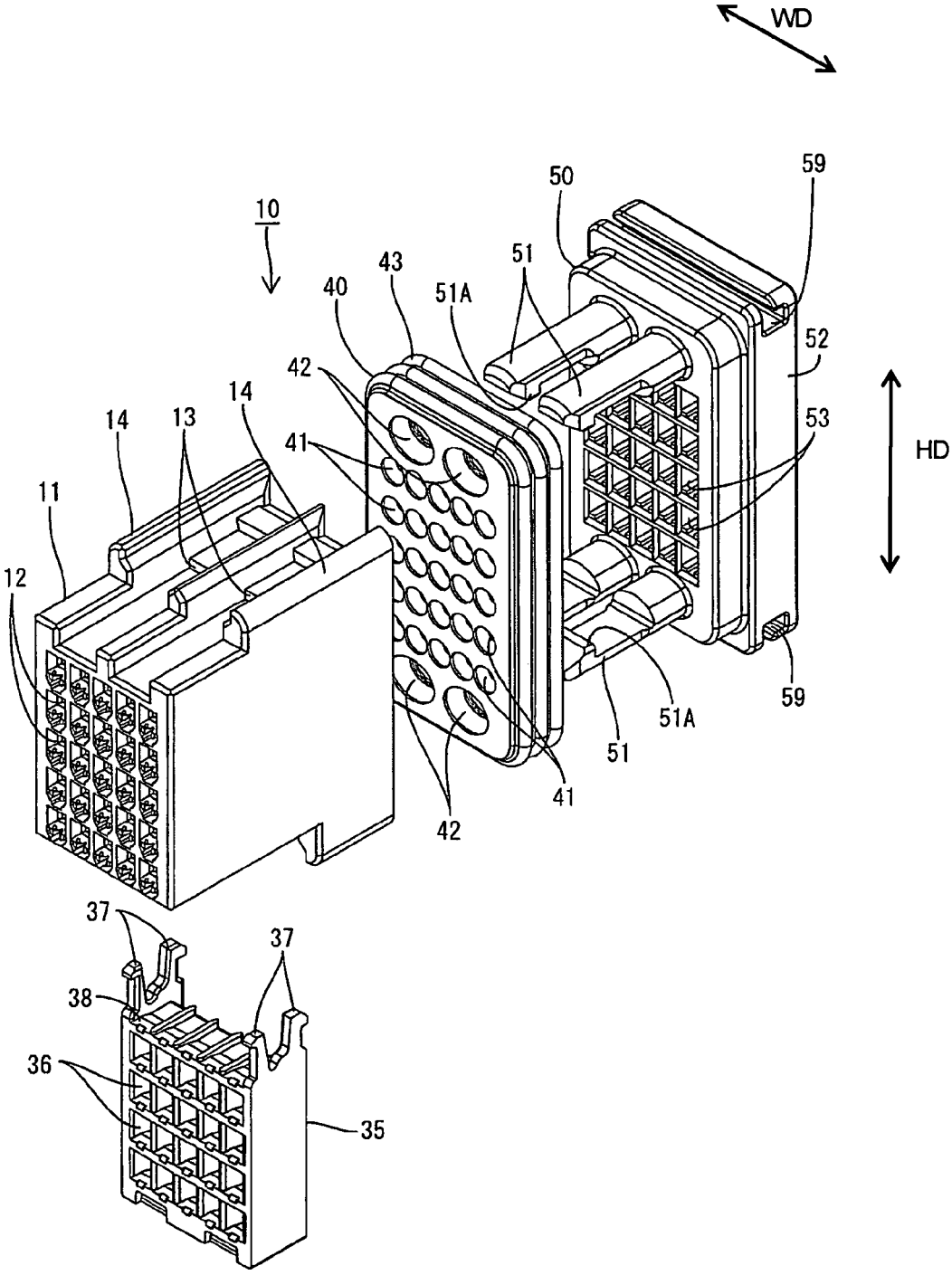
FIG. 3 is an exploded perspective view of a auxiliary connector.

Auxiliary connectors 10 of a plurality of sizes are prepared to correspond to the mating auxiliary connectors 10. Each auxiliary connector 10 includes a auxiliary housing 11, a retainer 35, a seal 40 and a rear holder 50 as shown in FIG. 3. The auxiliary housing 11 is a substantially rectangular parallelepiped made e.g. of a synthetic resin. Cavities 12 are formed in the auxiliary housing 11 and female terminal fittings 30 are insertable into the cavities 12 from behind. The cavities 12 are arranged in the width direction WD at each of a plurality of stages defined one after another along the height direction HD. Stepped engagements 13 are formed on the upper surface of the auxiliary housing 11 and are engageable in a hooking manner with locking claws 51A of respective locking legs 51 provided on the rear holder 50. Further, two protecting walls 14 project at the opposite sides of the upper surface of the auxiliary housing 11 for protecting the locking legs 51. The locking legs 51 are arranged between the protection walls 14, and hence will not be turned up or deflected by an external matter.

Figure 8:
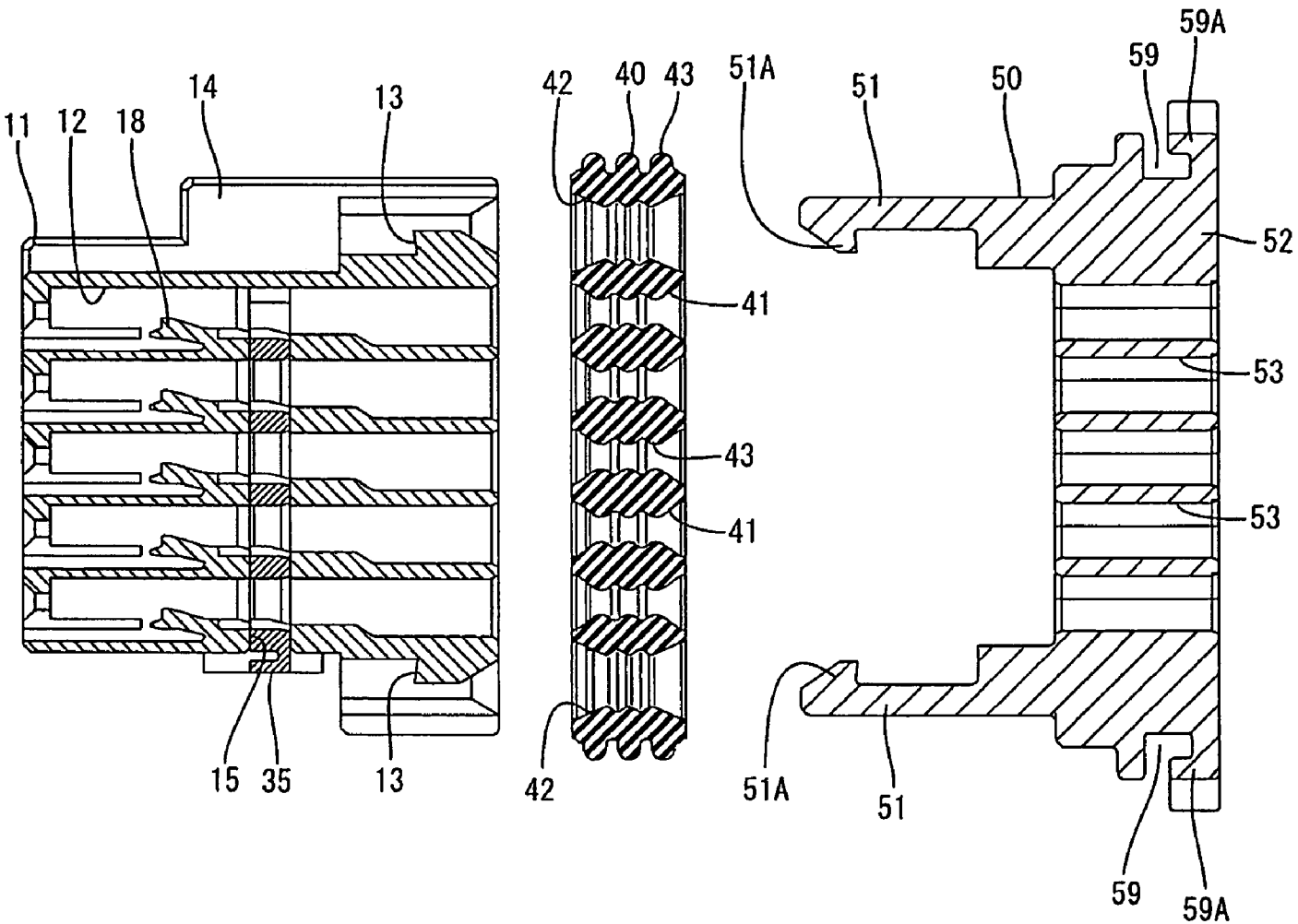
FIG. 8 is an exploded side view in section of the auxiliary connector.

As shown in FIG. 8, an insertion hole 15 is formed in the bottom surface of each auxiliary housing 11. The insertion hole 15 communicates with all of the cavities 12, and the side-type retainer 35 is inserted therein from below. The retainer 35 is a flat plate made e.g. of a synthetic resin. Terminal insertion holes 36 extend through the retainer 35 at positions corresponding to the cavities 12, and front and rear resilient locking pieces 37 project from opposite sides of the upper wall of the retainer 35. A locking projection 38 is formed at a wall of each terminal insertion hole 36, and the resilient locking pieces 37 engage with retainer locks (not shown) in the insertion hole 15. The retainer 35 is displaceable between a partial locking position and a full locking position, and is retained at these positions by the engagement of the resilient locking pieces 37 with the retainer locks. The locking projections 38 are retracted from the corresponding cavities 12 when the retainer 35 is at the partial locking position to permit insertion of the female terminal fittings 30. On the other hand, the locking projections 38 enter the cavities 12 and oppose the jaws 31 at the rear ends of the properly inserted female terminal fittings 30 when the retainer 35 is moved from the partial locking position to the full locking position for retaining the female terminal fittings 30.

Figure 11:
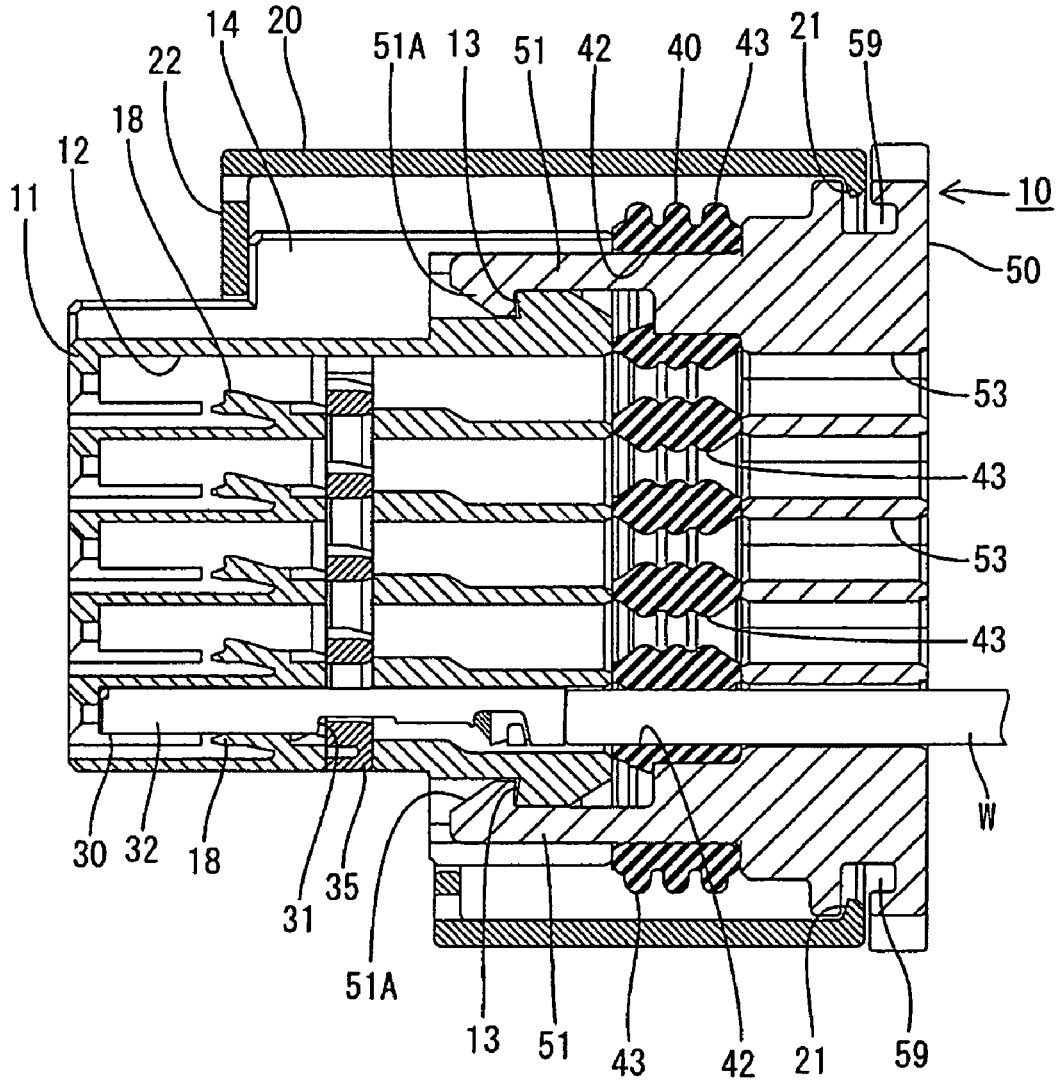
FIG. 11 is a side view in section showing a state where the protection cap is mounted on the auxiliary connector.

As shown in FIG. 3, the one-piece seal 40 made e.g. of a resilient material, such as rubber, is mounted on the rear surface of the auxiliary housing 11. The seal 40 contacts the rear surface of the auxiliary housing 11 and has wire insertion holes 41 at positions corresponding to the cavities 12. Wires W are connected with the female terminal fittings 30 by crimping, soldering, insulation displacement or the like, and can be passed through the respective wire insertion holes 41. Lips 43 are formed the inner circumferential surfaces of the wire insertion hoes 41 and are compressed resiliently by the wires W to achieve watertight contact with the outer circumferential surfaces of the wires W, as shown in FIG. 11. The seal 40 also has locking-leg insertion holes 42 at upper and lower positions with the respective wire insertion holes 41. The locking legs 51 can be inserted through the locking-leg insertion holes 42. Lips 43 also are formed on the outer peripheral surface of the seal 40. The seal 40 achieves watertight contact with the surrounding wall of the receptacle 91 while resiliently compressing the lips 43 when the mating auxiliary connector 90 is fit on the seal 40 to provide sealing between the mating auxiliary connector 90 and the seal 40.

The rear holder 50 for retaining the seal 40 includes a holder main body 52 made e.g. of a synthetic resin and has a substantially rectangular block shape. The holder main body 52 has insertion paths 53 at positions corresponding to the wire insertion holes 41 of the seal 40. The insertion paths 53 enable the female terminal fittings 30 and the wires W connected therewith to be inserted into the wire insertion holes 41. The insertion paths 53 have diameters equal to or slightly larger than box portions 32 of the female terminal fittings 30, so that the wires W connected with the female terminal fittings 30 can be inserted loosely therethrough. Substantially plate-shaped locking legs 51 project forward at upper and lower positions of the holder main body 52 with the respective insertion paths 53. The locking legs 51 have lengths to extend through the locking-leg insertion holes 42 of the seal 40 and onto the upper or lower surface of the auxiliary housing 11. Locking claws 51A are formed at the leading ends of the locking legs 51 and can engage the engaging portions 13 of the auxiliary housing 11 to mount the rear holder 50 fixedly on the auxiliary housing 11 with the seal 40 sandwiched between the auxiliary housing 11 and the rear holder 50. Rear holders 50 having up to three pairs of upper and lower locking legs 51 are prepared conforming to the sizes of the respective auxiliary housings 11.

Figure 5:
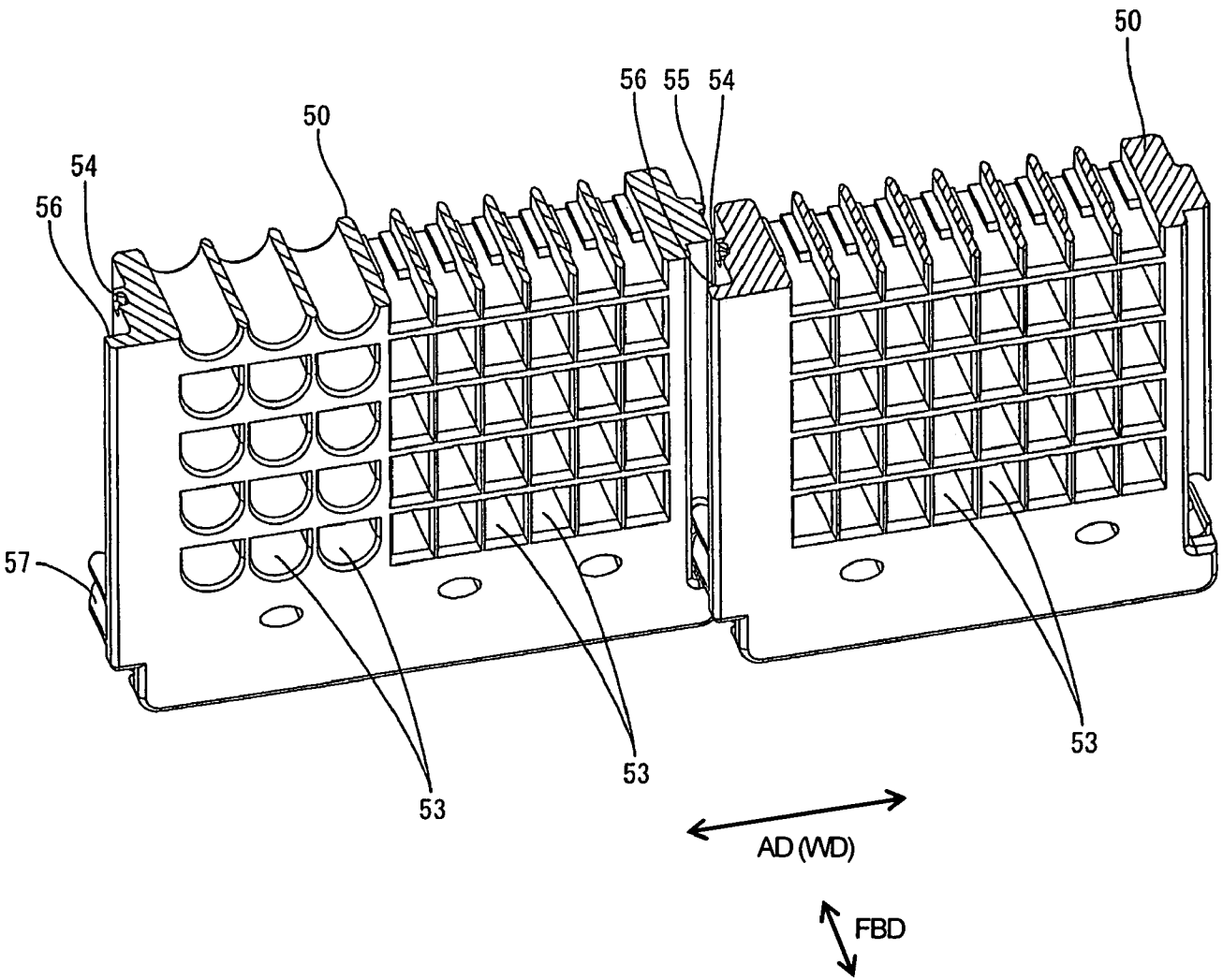
FIG. 5 is a perspective view with a horizontal section showing an essential portion immediately before two adjacent rear holders are coupled.
Figure 6:
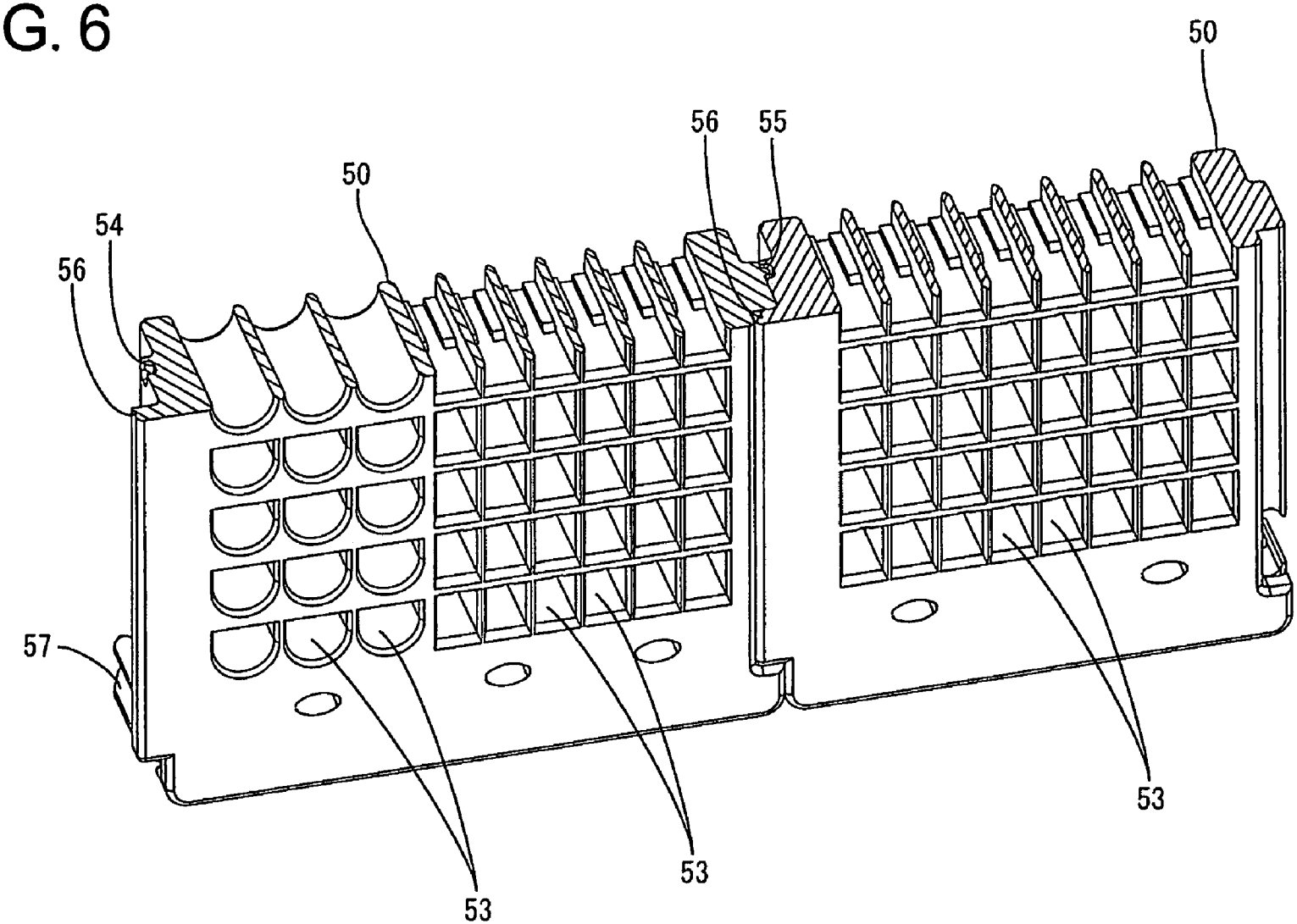
FIG. 6 is a perspective view with a horizontal section showing an essential portion when the two adjacent rear holders are coupled.

The rear holders 50 are coupled in an arranging direction AD that is parallel to the width direction WD so that their lateral edges abut each other. Thus, the rear holders 50 hold the auxiliary housings 11 substantially side by side. More specifically, as shown in FIGS. 5 and 6, a recess 54 and a projection 55 are provided on surfaces of two rear holders 50 adjacent to each other in the arranging direction AD. The projection 55 fits into the recess 54 by sliding the lateral edges of the two adjacent rear holders 50 along forward and backward directions FBD (substantially normal to the arranging direction AD). A positioning piece 56 projects from one of the rear holders 50 towards the other and contacts a step of the other rear holder when the coupling operation is completed to prevent displacements of the two rear holders 50 in at least one of the directions along forward and backward directions FBD.

Figure 7:
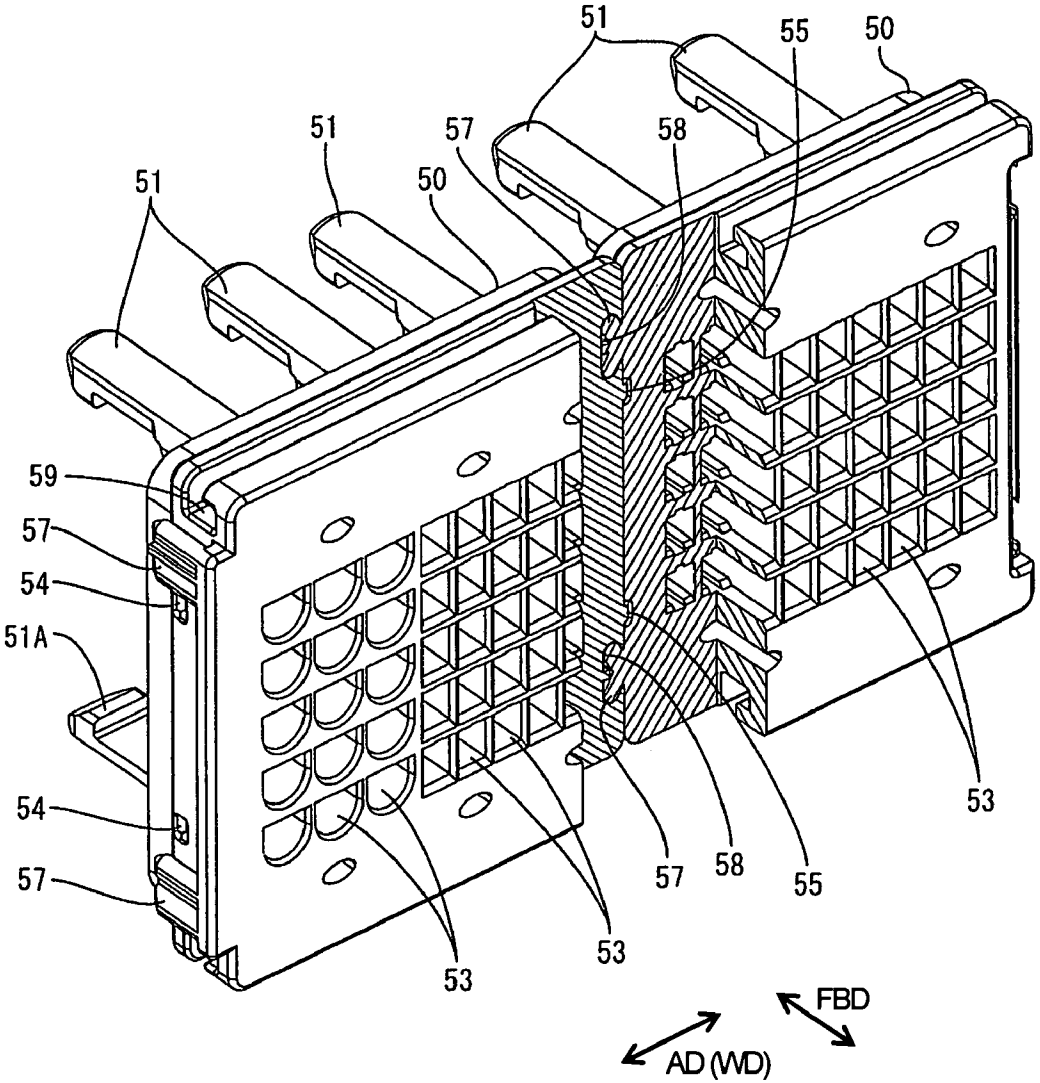
FIG. 7 is a perspective view with a vertical section showing an essential portion when the two adjacent rear holders are coupled.

As shown in FIG. 7, interengageable guide ribs 57 and guide-rib receiving grooves 58 are formed on facing surfaces of the two rear holders 50 that are adjacent to each other in the arranging direction AD and at height positions different from the recess 54 and projection 55. The guide ribs 57 have a dovetail cross section and extend in forward and backward directions FBD. Thus an assembling operation of the rear holders 50 is guided by relative sliding movements of the guide ribs 57 and the guide-rib receiving grooves 58. The dovetail engagement of the guide ribs 57 and the guide-rib receiving grooves 58 prevents the rear holders 50 from being separated along the width direction WD or arranging direction AD. The engaging heights of the guide ribs 57 and the guide-rib receiving grooves 58 are different among the respective rear holders 50. Thus, a correct combination of two rear holders 50 will conform and can be engaged. However, an incorrect combination of rear holders 50 will not conform and cannot be engaged. Thus, an erroneous mounting of the two rear holders 50 is prevented.

Guidable grooves 59 extend in the arranging direction AD in both upper and lower surfaces of the two rear holders 50 and open in the opposite lateral surfaces of the rear holders 50. Guides 65 are formed in the frame 60 and slide along the guidable grooves 59 to guide and insert the rear holders 50 and the auxiliary connectors 10 into the frame 60.

Figure 4:
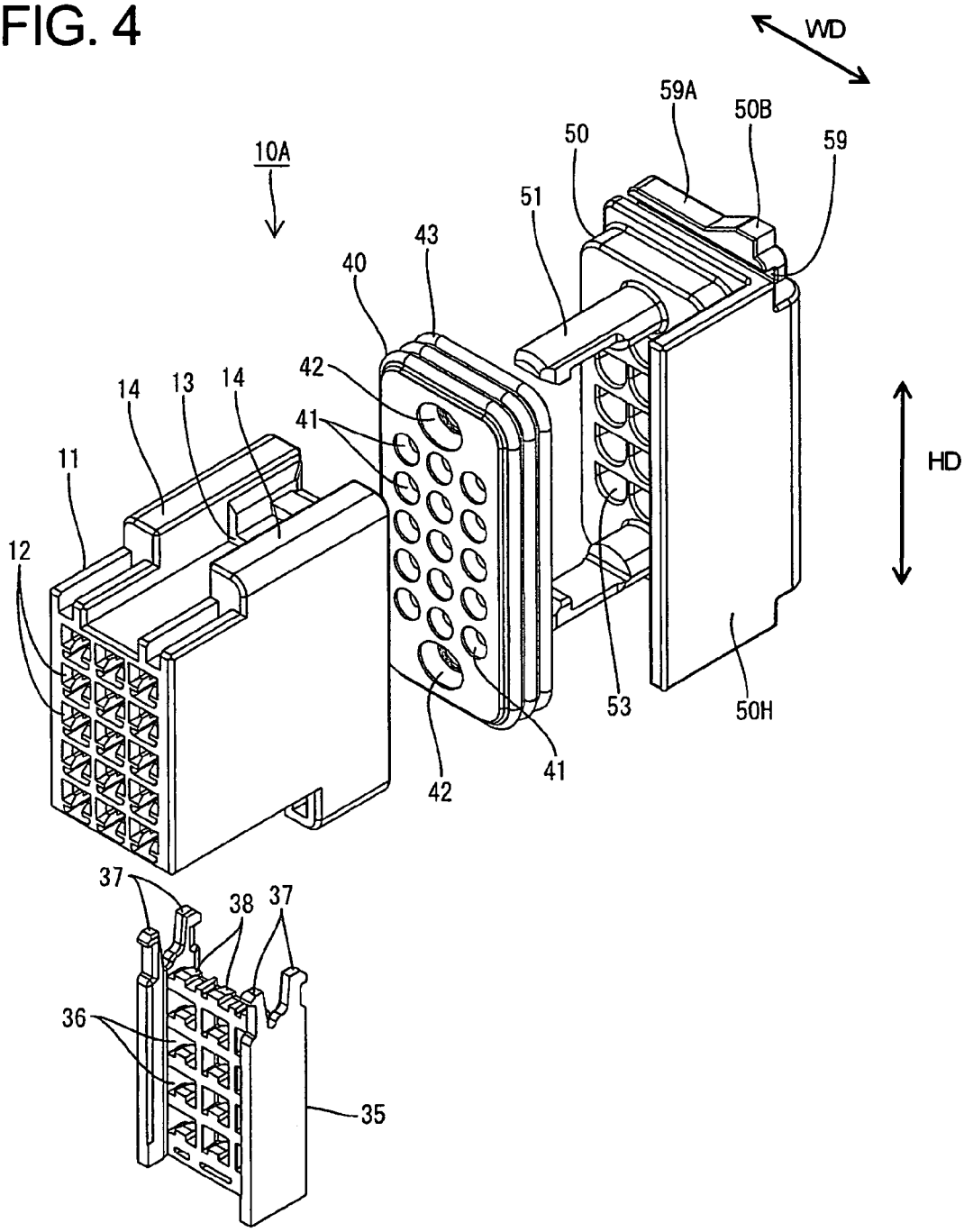
FIG. 4 is an exploded perspective view of an auxiliary connector inserted last into a frame.

As shown in FIG. 4, only one lock 50B engageable with the frame 60 is formed on the upper surface of the rear holder 50 of the auxiliary connector 10 inserted last into the frame 60 (hereinafter, last auxiliary connector 10A). The lock 50B projects on the upper surface of a covering wall 59A for covering the guidable groove 59, and is resiliently engageable with an interlocking portion 61 formed in the frame 60 by resiliently deforming the covering wall 59A into the guidable groove 59. Further, the last auxiliary connector 10A has a protection wall 50H that projects forward from one lateral edge of the rear holder 50. The protection wall 50H extends substantially along one lateral end surface of the seal 40. More specifically, the protection wall 50H defines a closing plate that extends over the entire height direction HD to conceal an exposed end surface of the seal 40 in an insertion opening 60A of the frame 60 when the last auxiliary housing 11 is mounted into the frame 60.

Figure 1:
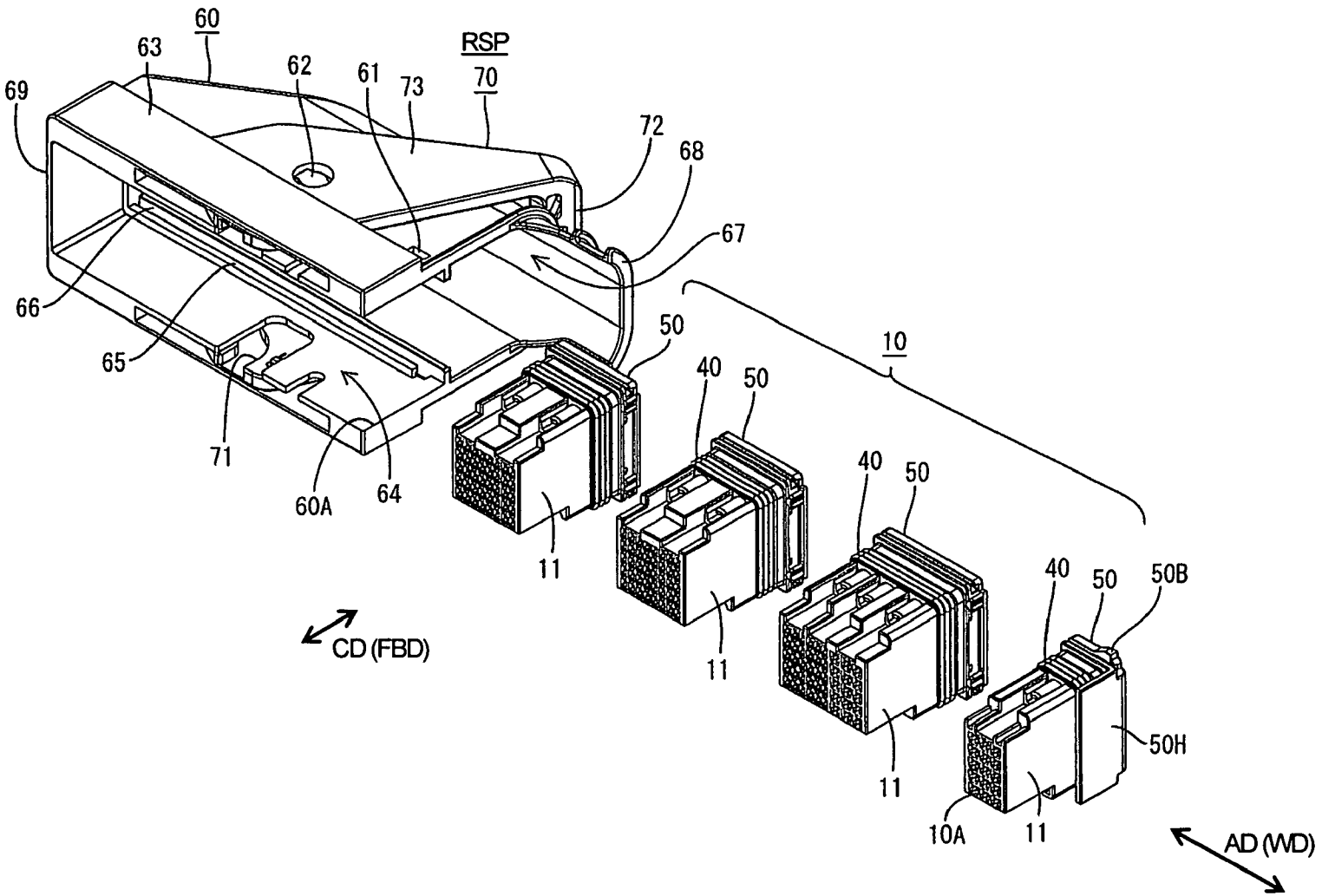
FIG. 1 is an exploded perspective view entirely showing a connector according to one embodiment.
Figure 2:
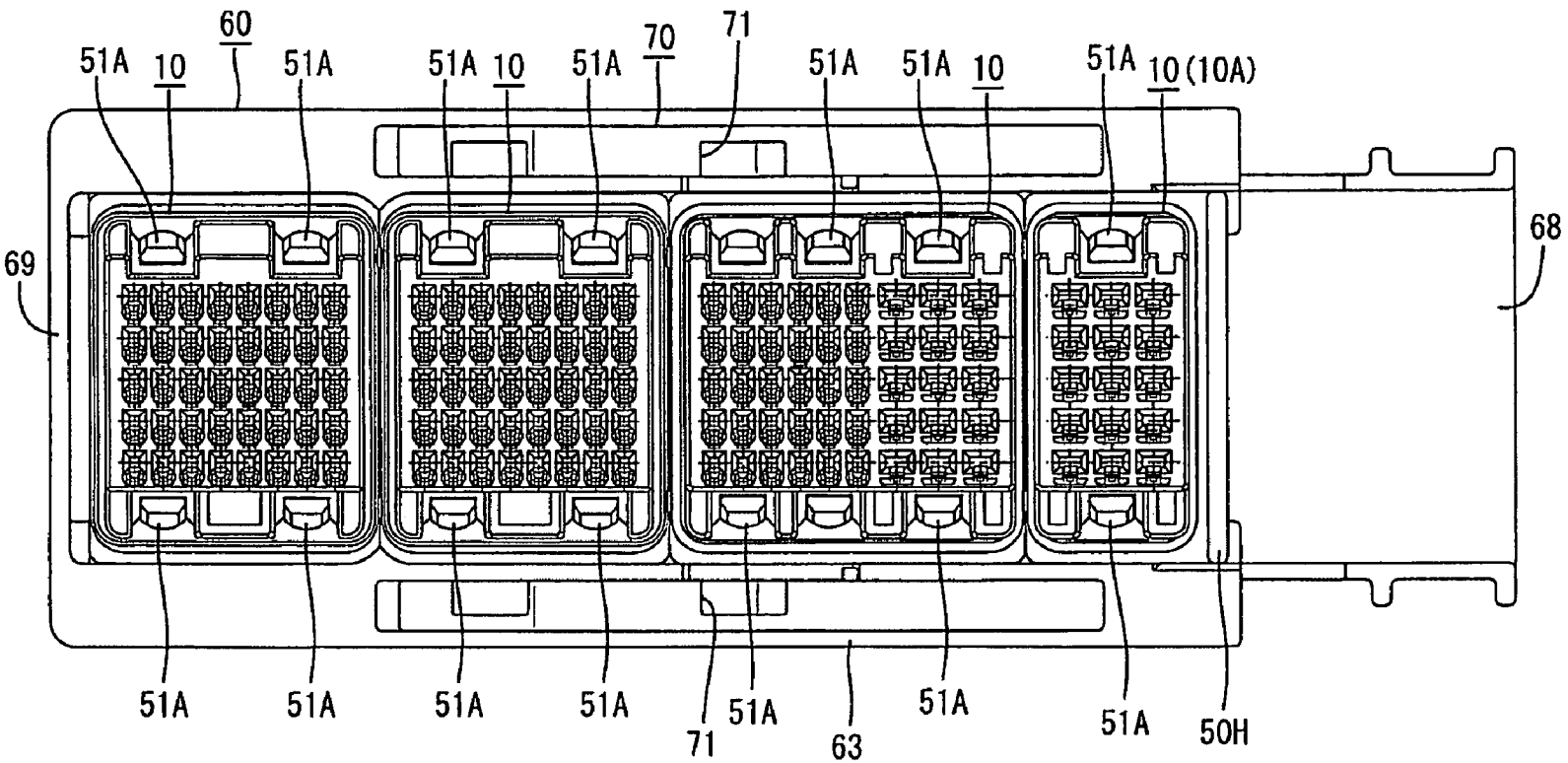
FIG. 2 is a front view showing the entire connector.

The frame 60 similarly is made e.g. of a synthetic resin and is in the form of a flat framework with an open front surface and one open side surface, as shown in FIGS. 1 and 2. The auxiliary connectors 10 can be successively mounted substantially along the arranging direction AD into the frame 60 through the insertion opening 60A in the open side surface of the frame 60. Supporting shafts 62 project from the upper and lower walls of the frame 60 and rotatably support the lever 70. The lever 70 has an operable portion 72 and arms 73 extend from opposite ends of the operable portion 72 to define a U-shape. The lever 70 spans the frame 60 so that the arms 73 are supported on the supporting shafts 62. Thus, the lever 70 can be rotated counterclockwise in an operating direction from a rotation starting position RSP shown in FIG. 1 to a rotation ending position in engagement with a side wall of the frame 60. The arms 73 of the lever 70 have cam grooves 71 for engaging the cam pins 95 of the mating auxiliary connectors 10.

The auxiliary connectors 10 are mounted into the frame 60 and the lever 70 is moved to the rotation starting position RSP. The mating auxiliary connectors 90 then are connected sufficiently with the corresponding auxiliary connector 10 for the cam pins 95 to enter the cam grooves 71 of the lever 70. The lever 70 then is rotated towards the rotation ending position so that the cam pins 95 move along the cam grooves 71 and generate a cam action therebetween. As a result that the two connectors are pulled toward each other. Opening preventing walls 63 are provided on the upper and lower walls of the frame 60 to cover the outer sides of the arms 73. Hence, the arms 73 will not deform away from each other upon connecting the connectors.

The frame 60 has a connector accommodating space 64 for accommodating the auxiliary connectors 10 en bloc without being partitioned by partition walls. Additionally, two rail-shaped guides 65 are provided on the inner surfaces of the upper and lower walls and extend in arranging direction AD. Two receiving walls 66 are formed on the inner surfaces of the upper and lower walls of the frame 60 and extend substantially parallel to the guides 65 but behind the guides 65. Substantially rectangular interlocking holes 61 penetrate the upper and lower walls of the frame 60 near the insertion opening 60A. The connector accommodating space 64 is defined in an area of the frame 60 before the receiving walls 66 and a wire accommodating space 67 is defined in an area of the frame 60 behind the receiving walls 66 for accommodating the wires W drawn out through the rear surfaces of the rear holders 50 substantially en bloc. The frame 60 also has a rear wall 68 for bending and guiding the wires W drawn out from the auxiliary connectors 10 at a substantially right angle and substantially towards the same side as the insertion opening 60A.

The auxiliary connectors 10 are slid into the frame 60 substantially in their arranging direction AD through the insertion opening 60A and are united with each other by means of the rear holders 50. At this time, the guidable portions 59 and the guides 65 are engaged in forward and backward directions FBD to position the auxiliary connectors 10 in the frame 60 with respect to forward and backward directions FBD. The lock 50B of the rear holder 50 fits into the interlocking hole 61 of the frame 60 when the last auxiliary connector 10A is mounted. As a result, the respective auxiliary connectors 10 are positioned with respect to width direction WD (arranging direction AD) and are prevented from coming out of the insertion opening 60A. Additionally, the lateral edge of the first auxiliary connector 10 contacts the back wall 69 of the frame 60 to prevent any further insertion of the auxiliary connectors 10. Upon connecting the auxiliary connectors 10 with the mating auxiliary connectors 90, pressing forces act in the connecting direction CD of the mating auxiliary connectors 90. However, the receiving walls 66 receive these pressing forces and hinder backward displacements of the auxiliary connectors 10.

Figure 9:
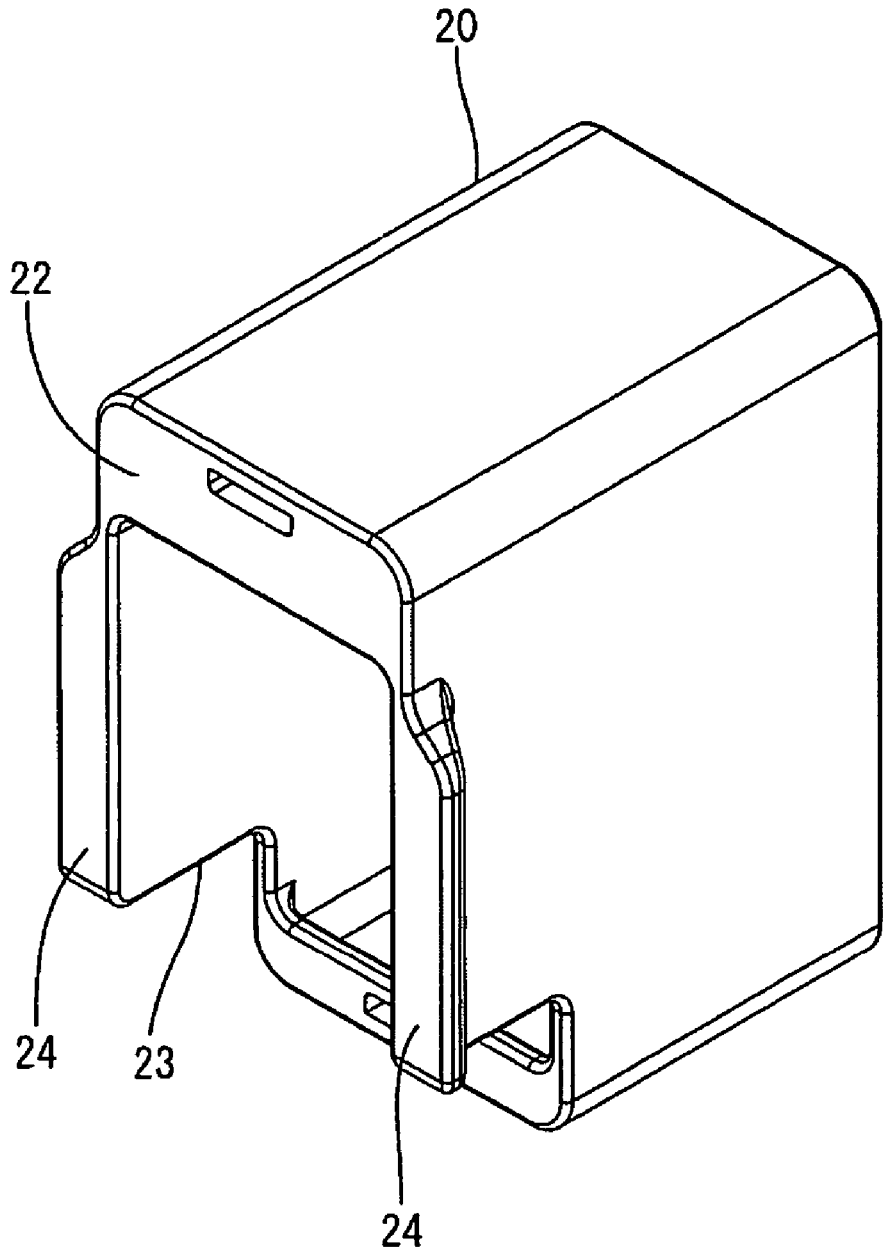
FIG. 9 is a perspective view of a protection cap.
Figure 10:
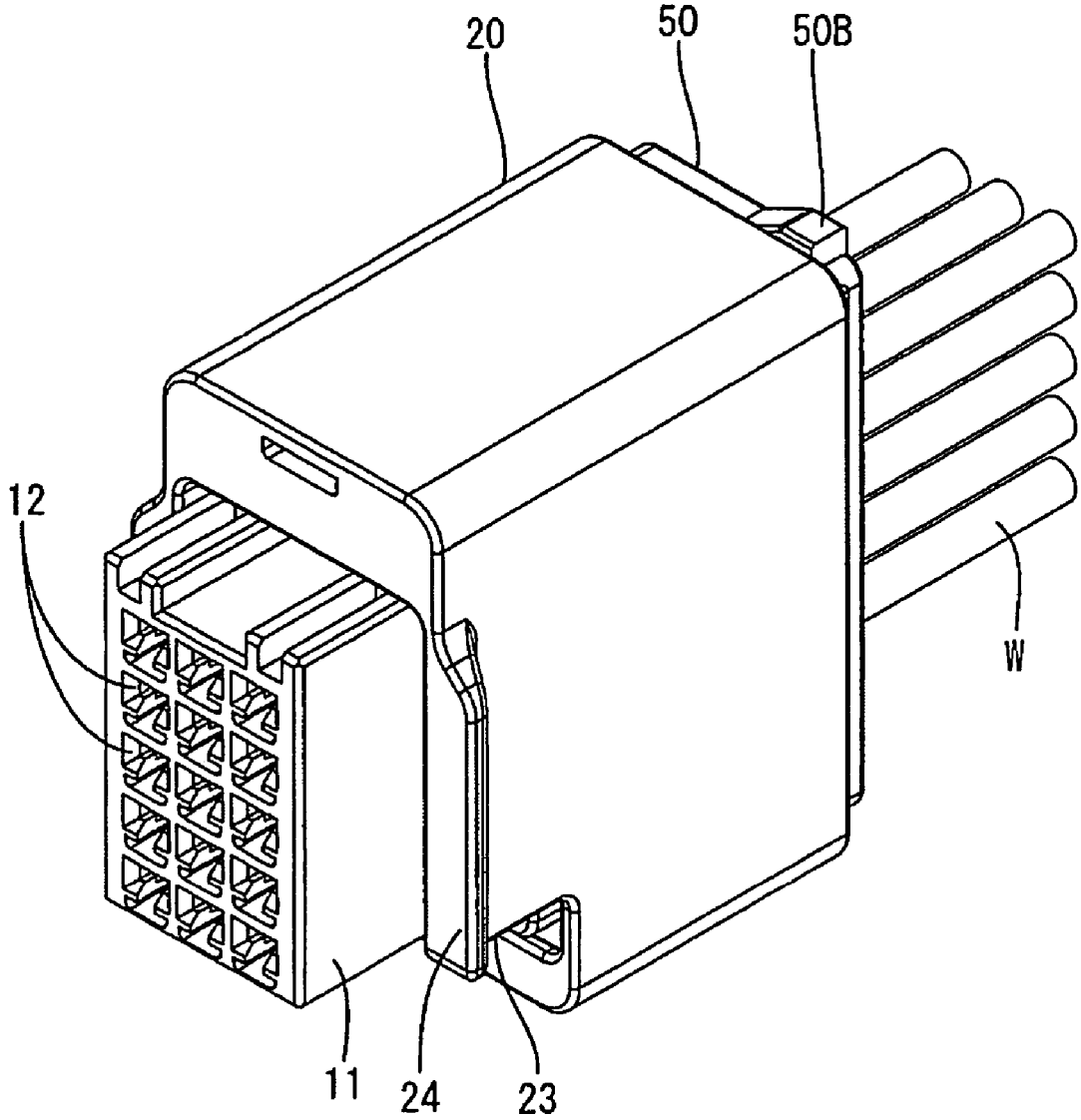
FIG. 10 is a perspective view showing a state where the protection cap is mounted on the auxiliary connector.

The seals 40 are protected by protection caps 20 until the auxiliary connectors 10 are united by the rear holders 50. Each protection cap 20 is made e.g. of a synthetic resin, and has a tubular shape with open front and rear ends. Thus, the protection cap 20 can surround the side surfaces of the corresponding auxiliary housing 11, as shown in FIGS. 9 and 10. The protection cap 20 is mounted on the auxiliary connector 10 from the front, and temporary holding claws 21 at the rear end of the protection cap 20 resiliently engage the guides 59 in a hooking manner to hold the protection cap 20 temporarily on the auxiliary connector 10. The temporarily held protection cap 20 is arranged to surround the corresponding auxiliary housing 11 and seal 40 while defining clearances thereto. A hanging wall 22 is formed at the front upper part of the protection cap 20 and opposes the locking-leg projection walls 14 on the auxiliary housing 11. A retainer insertion opening 23 is formed in the bottom surface of each protection cap 20 at a position corresponding to the insertion hole 15 for the retainer 35 and is used to pass the retainer 35 into the insertion hole 15.

The protection cap 20 is mounted onto the corresponding auxiliary connector 10 from front before the female terminal fittings 30 are mounted into the auxiliary housing 11. The protection cap 20 is pulled forward after the female terminal fittings 30 are mounted and the retainer 35 is mounted, thereby forcibly disengaging the temporarily holding claws 21 from the guidable portions 59 to detach the protection cap 20 from the auxiliary connector 10. Flanges 24 bulge out sideways from the opposite lateral edges of the opening of the protection cap 20 and can be gripped to pull the protection cap 20.

The connector is assembled by mounting the seal 40 to the rear surface of each auxiliary housing 11. The rear holder 50 then is mounted by passing the locking legs 51 of the rear holder 50 through the respective locking-leg insertion holes 42 of the seal 40. The locking claws 51A of the locking legs 51 engage the corresponding engaging portions 13 of the auxiliary housing 11 to mount the rear holder 50 on the auxiliary housing 11 with the seal 40 therebetween.

The protection cap 20 then is mounted from the front to fit the resilient temporary holding claws 21 of the protection cap 20 into the guidable groove 59 to protect the seal 40. The respective auxiliary connectors 10 are shipped to a harness assembling site with the seals 40 protected by the protection caps 20. At the assembling site, the retainer 35 is inserted from below through the retainer insertion opening 23 of the protection cap 20 and into the auxiliary housing 11 to hold the retainer 35 at the partial locking position. In this state, the female terminal fittings 30 connected with the wires W are inserted from behind through the insertion paths 53 of the rear holder 50, through the wire insertion holes 41 of the seal 40, and into the respective cavities 12 of the auxiliary housing 11. Locks 18 in the cavities 12 resiliently deform during insertion of the female terminal fittings 30, but then resiliently return to engage the properly inserted female terminal fittings 30. The retainer 35 then is inserted deeper to the full locking position as shown in FIG. 11. Thus, the locking projections 38 of the retainer 35 engage the female terminal fittings 30 to retain the female terminal fittings 30 securely. The flanges 24 then are gripped and pulled forward. As a result, the temporary holding claws 21 are released from the guiding grooves 59, and the protection cap 20 can be detached from the auxiliary connector 10.

Two adjacent rear holders 50 are slid into engagement in forward and backward directions FBD after the female terminal fittings 30 are mounted in the auxiliary connectors 10. Thus, the guide ribs 57 engage in the guide-rib receiving grooves 58, and the projection 55 engages the recess 54 to prevent separation of the adjacent rear holders 50. The rear holder 50 of another auxiliary housing 10 then is coupled to one of the two connected rear holders 50. In this way, the auxiliary connectors 10 are coupled successively in the arranging direction AD. In this embodiment, four auxiliary connectors 10 are assembled, and the last auxiliary connector 10A is at the right end. The guidable grooves 59 of the connected auxiliary connectors 10 are substantially continuous on a substantially straight line along the width direction WD (arranging direction AD). Any small discontinuity is corrected by the interaction of the guidable grooves 59 of the auxiliary connector 10 and the guides 65 of the frame 60.

The connected auxiliary connectors 10 then are inserted into through the insertion opening 60A of the frame 60 and into the connector accommodating space 64. The guidable portions 59 of the auxiliary connector 10 at the left end are fit to the guides 65 of the frame 60 at the start of the inserting operation, and the respective auxiliary connectors 10 are pushed toward the back side of the connector accommodating space 64 in this state. The lock 50B on the last auxiliary housing 10A engages the interlocking hole 61 of the frame 60 as the auxiliary connectors 10 reach proper mount positions. The seal 40 of the last auxiliary connector 10A faces the insertion opening 60A of the frame 60 when the auxiliary connectors 10 are mounted properly. Thus, the exposed end surface of the seal 40 is concealed by the protection wall 50H of the rear holder 50H to protect the seal 40 from external matter (see FIG. 2). The auxiliary connectors 10 are positioned relative to the frame 60 with intervals therebetween held substantially constant by the rear holders 50. Further, the wires W drawn out from the respective auxiliary connectors 10 are bundled in the wire accommodating space 67, and pulled out in a specified direction.

The mating auxiliary connectors 90 are fit loosely to the auxiliary connectors 10 and the lever 70 is rotated to connect the auxiliary connectors 10, 90 to a proper depth. During this connection, the partition walls 92 of the mating auxiliary connectors 90 slide into clearances between the facing surfaces of the adjacent rear holders 50 and the auxiliary connectors 10, 90 are guided to a smooth connection by the facing surfaces, as shown in FIG. 13. When the auxiliary connectors 10, 90 are connected properly, the seals 40 are resiliently compressed in forward and backward directions FBD by connection compressing forces between the mating auxiliary connectors 90 and the receiving walls 66. Thus, the wire insertion holes 41 are narrowed for close sealing contact the outer surfaces of the wires W. Further, the surrounding walls of the receptacles 91 closely fit onto the seals 40 so that the lips 43 of the seals 40 are squeezed at the surrounding walls of the receptacles 91 when the auxiliary connectors 10, 90 are connected properly. As a result, secure sealing is provided between the seals 40 and the mating auxiliary connectors 90.

As described above, there are no partition walls between the adjacent auxiliary connectors 10. Thus, the connector is smaller by the total thickness of the partition walls. The auxiliary connectors 10 are united by the rear holders 50 and then are inserted into the frame 60 in the arranging direction AD. Thus, the positions of the auxiliary connectors 10 in the frame 60 are determined, and the auxiliary connectors 10 can positioned in the frame 60 without the partition walls. The seals 40 would not seal well if coupling structures were provided between the auxiliary connectors 10. However, good sealing performances is achieved by the seals 40 of this embodiment because the respective auxiliary connectors 10 are united by the rear holders 50.

The auxiliary connectors 10 are coupled by the rear holders 50 inserted into the frame 60. Thus, assembling efficiency is good. Furthermore, rear holders 50 are provided in one-to-one correspondence with the respective auxiliary connectors 10 and can be coupled to each other in the arranging direction. Thus, the operation of inserting the female terminal fittings 30 can be performed for each auxiliary connector 10. As a result, the female terminal fittings 30 are inserted properly and the wires W can be handled easily.

The seals 40 are protected by the protection caps 20 and the protection wall 50H before connection with the mating connectors. Thus, specified sealing performance is assured. The protection cap 20 is mounted utilizing the guides 59, and a special construction is not needed for mounting the protection cap 20 on the auxiliary connector 10.

The partition walls 92 of the mating auxiliary connectors 90 slide into the clearances between the facing surfaces of the adjacent auxiliary connectors 10 to prevent forcible connection of the auxiliary connectors 10, 90. Therefore, a special forcible-connection preventing construction is not needed and the connector can be miniaturized further.

The seals 40 provide sealing with the mating auxiliary connectors 90 and with the wires W. Thus, plural kinds of seals 40 are not needed, thereby reducing the number of parts.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The auxiliary connectors are inserted into the frame after being united by the rear holders in the foregoing embodiment. However, they may be inserted into the frame individually or in smaller groups through the insertion opening and may be united in the frame. In short, it is sufficient to be able to accommodate the respective auxiliary connectors while determining the positions thereof relative to the frame even if there are no partition walls.

The rear holder is provided for each auxiliary connector in the foregoing embodiment. However, one rear holder may be provided for all or some of auxiliary connectors according to the invention.

The lock engageable with the frame is provided only on the last auxiliary connector in the foregoing embodiment. However, it may be provided on each auxiliary connector according to the invention.

The protection caps are kept mounted on the auxiliary connectors during the operation of mounting the female terminal fittings in the foregoing embodiment. However, they may be detached from the auxiliary connectors before starting the operation of mounting the female terminal fittings.

The invention is also applicable to a male connector in which auxiliary connectors having male terminal fittings therein are accommodated in a frame.

The invention is also applicable to nonwatertight connectors. In such a case, means for positioning auxiliary connectors relative to a frame may be provided on the auxiliary housings.

The invention is also applicable to connectors being connectable to each other without the assistance of a lever displaying a cam action.

In the above embodiment the auxiliary connectors are inserted into the frame through a single opening in the side surface. However, it should be understood that the auxiliary connectors may be inserted into openings in the side surface and/or back surface and/or front surface of the frame.

A rotatable lever is described as the preferred operable member. However, other operable member, such as sliders having a substantially linear operation path may be used to connect the connectors.

What is claimed is:

1. A connector, comprising:

a frame with opposite front and rear ends and opposite side surfaces, an opening formed in one of the side surfaces of the frame;

a plurality of auxiliary connectors, each of the auxiliary connectors having opposite front and rear ends and opposite side surfaces, the auxiliary connectors accommodating terminal fittings aligned substantially parallel to one another and along directions between the front and rear ends of the auxiliary connectors, the auxiliary connectors being configured for insertion into the frame en bloc through the opening in the side surface of the frame along an arrangement direction extending substantially between the side surfaces of the frame so that front end of the auxiliary connectors are substantially at the front end of the frame; and positioning means on at least one of the auxiliary connectors and the frame for determining the positions of the auxiliary connectors relative to the frame.

2. The connector of claim 1, wherein a clearance is defined between facing surfaces of two auxiliary connectors adjacent to each other in the arranging direction for receiving a partition wall of at least one mating auxiliary connector when the two auxiliary connectors are connected with the mating auxiliary connectors.

3. The connector of claim 1, wherein at least one seal is arranged at a rear part of the auxiliary connectors for providing sealing around one or more wires connected with terminal fittings.

4. The connector of claim 3, wherein a wall of the mating auxiliary connector is configured for hermetic contact with an outer surface of the seal.

5. The connector of claim 3, wherein at least one rear holder is assembled at a rear part of the respective auxiliary connectors for retaining the seal.

6. The connector of claim 3, wherein the auxiliary connectors are united substantially in the arranging direction by at least one rear holder and accommodated into the frame in a united state.

7. The connector of claim 6, wherein a plurality of rear holders are provided in one-to-one correspondence with the respective auxiliary connectors and are coupled to each other substantially in the arranging direction.

8. The connector of claim 7, wherein engaging portions are provided on substantially facing surfaces of two rear holders adjacent to each other in the arranging direction, and the engaging portions are engaged to permit assembly of the two rear holders when the two rear holders are arranged in a correct combination, and cannot be engaged to hinder assembly of the two rear holders when the two rear holders are arranged in a wrong combination.

9. A connector, comprising:

a frame with a side surface, an opening formed in the side surface of the frame;

a plurality of auxiliary connectors accommodating terminal fittings, the auxiliary connectors being configured for insertion into the frame en bloc substantially in an arranging direction through the opening in the side surface of the frame;

positioning means on at least one of the auxiliary connectors and the frame for determining the positions of the auxiliary connectors relative to the frame;

at least one seal arranged at a rear part of the auxiliary connectors for providing sealing around one or more wires connected with terminal fittings; and at least one rear holder assembled at a rear part of the respective auxiliary connectors for retaining the seal, wherein the rear holder is formed with at least one protection wall for concealing an exposed end surface of the seal substantially facing the insertion opening at the auxiliary connector inserted last into the frame.

10. The connector of claim 3, wherein at least one protection cap is detachably mountable on the respective auxiliary connectors and at least partly surrounds the seal while defining a clearance thereto.

11. The connector of claim 10, wherein a retainer is assembled into at least one of the auxiliary connectors for retaining the properly inserted terminal fittings by engaging the terminal fittings, and the protection cap being formed with at least one retainer insertion opening for permitting insertion of the retainers into the respective auxiliary connectors.

12. A connector, comprising:

a frame with a side surface, an opening formed in the side surface of the frame;

a plurality of auxiliary connectors accommodating terminal fittings, the auxiliary connectors being configured for insertion into the frame en bloc substantially in an arranging direction through the opening in the side surface of the frame;

positioning means on at least one of the auxiliary connectors and the frame for determining the positions of the auxiliary connectors relative to the frame;

at least one seal arranged at a rear part of the auxiliary connectors for providing sealing around one or more wires connected with terminal fittings; and at least one protection cap detachably mountable on the respective auxiliary connectors and at least partly surrounds the seal while defining a clearance thereto wherein each auxiliary connector is formed with at least one guide that can be brought into sliding contact with at least one guide of the frame when the auxiliary connector is mounted into the frame, and the protection cap is formed with at least one mounting portion detachably engageable with the guide before the respective auxiliary connectors are mounted into the frame.

* * * * *